US009723410B2

(12) United States Patent
Sell

(10) Patent No.: US 9,723,410 B2
(45) Date of Patent: Aug. 1, 2017

(54) SPEAKER ASSEMBLY

(71) Applicant: Harman International Industries, Incorporated, Stamford, CT (US)

(72) Inventor: David J. Sell, White Lake, MI (US)

(73) Assignee: Harman International Industries, Incorporated, Stamford, CT (US)

( * ) Notice: Subject to any disclaimer, the term of this patent is extended or adjusted under 35 U.S.C. 154(b) by 147 days.

(21) Appl. No.: 14/325,927

(22) Filed: Jul. 8, 2014

(65) Prior Publication Data

US 2016/0014523 A1 Jan. 14, 2016

(51) Int. Cl.

| | |
|---|---|
| ***H04R 9/04*** | (2006.01) |
| ***H04R 9/06*** | (2006.01) |
| ***H04R 31/00*** | (2006.01) |
| ***H04R 9/02*** | (2006.01) |

(52) U.S. Cl.

CPC ..... *H04R 9/045* (2013.01); *H04R 9/025* (2013.01); *H04R 9/06* (2013.01); *H04R 31/00* (2013.01); *H04R 31/006* (2013.01); *H04R 2209/024* (2013.01); *H04R 2231/003* (2013.01); *H04R 2400/11* (2013.01)

(58) Field of Classification Search

CPC .. H04R 2400/11; H04R 1/026; H04R 1/2896; H04R 2400/00; H04R 2209/024; H04R 9/045; H04R 9/025; H04R 9/06; H04R 31/00; H04R 31/006; H04R 2231/003; G10K 13/00; G10K 9/122; G10K 9/13; G10K 9/20

USPC ..... 381/398, 355, 356, 335, 332, 334, 423, 381/396

See application file for complete search history.

(56) References Cited

U.S. PATENT DOCUMENTS

| | | | | |
|---|---|---|---|---|
| 2,894,182 A * | 7/1959 | Zuerker | H01F 7/0289 335/296 |
| 3,133,162 A | 5/1964 | Coen | |
| 3,176,086 A * | 3/1965 | Coen | H04R 9/02 335/231 |
| 3,240,882 A * | 3/1966 | Eichler | H04R 9/06 335/231 |
| 3,296,386 A * | 1/1967 | Fanselow | H04R 1/222 381/354 |

(Continued)

FOREIGN PATENT DOCUMENTS

| | | |
|---|---|---|
| GB | 1013161 | 12/1965 |
| WO | 9858520 A1 | 12/1998 |

OTHER PUBLICATIONS

European Patent Office, extended European Search Report for corresponding European Patent Application No. 15164690.8 mailed Oct. 22, 2015.

(Continued)

*Primary Examiner* — Davetta W Goins
*Assistant Examiner* — Oyesola C Ojo
(74) *Attorney, Agent, or Firm* — Brooks Kushman P.C.

(57) ABSTRACT

A speaker assembly includes a shellpot for receiving a speaker motor, the shellpot including an upstanding rim on an upper portion of the shellpot, and speaker basket including a base portion having an opening therein for receiving the shellpot. An insert member is disposed adjacent the speaker basket and the rim, wherein a plurality of sections of the rim are displaced to abut the insert member and couple the shellpot to the speaker basket. A method of assembling the speaker assembly is also provided.

16 Claims, 4 Drawing Sheets

(56) References Cited

U.S. PATENT DOCUMENTS

| | | | | |
|---|---|---|---|---|
| 3,614,335 | A * | 10/1971 | Dymoke-Bradshaw | H04R 7/18 381/354 |
| 4,520,237 | A | 5/1985 | Murakami | |
| 4,565,905 | A * | 1/1986 | Nation | H04R 1/24 381/182 |
| 4,752,963 | A | 6/1988 | Yamazaki et al. | |
| 4,815,558 | A | 3/1989 | Krainhofer | |
| 4,852,178 | A | 7/1989 | Inkman et al. | |
| 5,150,419 | A * | 9/1992 | Kizak | H04R 1/025 381/412 |
| 5,416,283 | A | 5/1995 | Dault et al. | |
| 6,075,866 | A | 6/2000 | Frasl et al. | |
| 6,178,252 | B1 | 1/2001 | Frasl et al. | |
| 7,079,665 | B2 | 7/2006 | Shimomura et al. | |
| 7,167,573 | B2 * | 1/2007 | Williamson | H04R 9/06 381/398 |
| 7,720,248 | B2 * | 5/2010 | Sasaki | H04R 9/06 181/148 |
| 7,822,221 | B2 | 10/2010 | Watanabe | |
| 7,873,178 | B2 | 1/2011 | Steere et al. | |
| 7,965,856 | B2 * | 6/2011 | Sato | H04R 1/06 381/396 |
| 7,995,785 | B2 * | 8/2011 | Royse | H04R 9/025 381/386 |
| 8,335,337 | B2 * | 12/2012 | Proni | H04R 9/025 381/403 |
| 2001/0017930 | A1 | 8/2001 | Matsudo et al. | |
| 2002/0044671 | A1 * | 4/2002 | Shimomura | H04R 9/02 381/386 |
| 2003/0219142 | A1 * | 11/2003 | Stompler | H04R 9/06 381/433 |
| 2007/0230738 | A1 * | 10/2007 | Royse | H04R 9/025 381/433 |
| 2009/0060250 | A1 | 3/2009 | Proni | |
| 2009/0180648 | A1 * | 7/2009 | Endo | H04R 1/24 381/184 |

OTHER PUBLICATIONS

European Patent Office, extended European Search Report for corresponding European Patent Application No. 15173499.3 mailed Sep. 11, 2015.

United States Patent and Trademark Office, Office Action for U.S. Appl. No. 14/265,689 mailed Apr. 22, 2015.

* cited by examiner

SPEAKER ASSEMBLY

TECHNICAL FIELD

Embodiments relate to a speaker assembly including a shellpot coupled with a speaker basket and a method of assembling the speaker assembly.

BACKGROUND

Plastic speaker baskets may be used to reduce weight and provide a low cost structure for certain speaker applications. Typically, plastic speaker baskets are molded directly over a metallic speaker shellpot, and then the rest of the speaker components are assembled in relation to the shellpot. However, the shellpot geometry often changes based on the design of the speaker assembly. Accordingly, new tooling, such as a new mold or mold detail, must be produced for each shellpot design, as well as each set of production tooling. As such, supporting multiple speaker designs can significantly increase manufacturing cost and complexity.

Some previous designs have accomplished attaching the shellpot to the plastic basket using either a twist lock design and/or using an adhesive to bond the shellpot to the plastic speaker basket. Although such designs allow the attachment of any of multiple shellpots to a common plastic basket, these designs may have insufficient durability for some applications. Further, a twisting or locking detail may lead to increased tooling complexity and manufacturing issues.

Loudspeakers convert electrical energy into sound and typically include a diaphragm, one or more magnets, a core cap, and a voice coil connected to the diaphragm and positioned in an air gap between the magnets and shellpot. The core cap can direct and concentrate a magnetic flux produced by the magnets into the air gap. When electrical energy flows into the voice coil, an induced magnetic field can be created that interacts with the magnetic flux in the air gap. The interaction between the voice coil current and the magnetic flux causes linear oscillation of the voice coil within the air gap, which moves the diaphragm in order to produce audible sound. However, the magnet structure of some loudspeakers may result in fringe magnetic fields that can increase the risk of reducing the efficiency of the loudspeaker. Magnetic flux density should be maintained across the length of the air gap for sufficient linear voice coil travel and optimal speaker performance.

SUMMARY

In one embodiment, a speaker assembly is provided including a shellpot for receiving a speaker motor, the shellpot including an upstanding rim on an upper portion of the shellpot, and speaker basket including a base portion having an opening therein for receiving the shellpot. An insert member is disposed adjacent the speaker basket and the rim, wherein a plurality of sections of the rim are displaced to abut the insert member and couple the shellpot to the speaker basket.

In another embodiment, a speaker assembly is provided including a shellpot for receiving a speaker motor, the shellpot including a an upstanding rim on an upper portion of the shellpot, and a speaker basket including a base portion having an opening therein for receiving the shellpot. A metallic insert ring is disposed adjacent the speaker basket and the rim, the insert ring having an inner portion which abuts the rim to couple the shellpot to the speaker basket and a generally concave outer portion extending into the speaker basket.

In another embodiment, a method of assembling a speaker assembly is provided including providing a shellpot including an upstanding rim on an upper portion of the shellpot and providing a speaker basket including a base portion having an opening therein. The method further includes placing the speaker basket over the shellpot such that the shellpot is received in the opening and placing an insert member over the shellpot adjacent the speaker basket and the rim. A plurality of sections of the rim are displaced to abut the insert member and couple the shellpot to the speaker basket.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
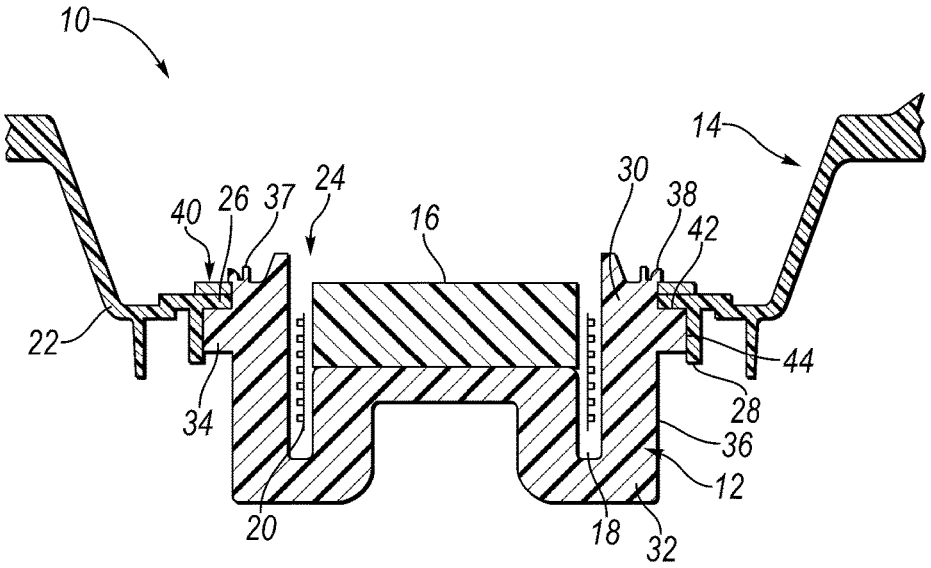
FIG. 1 is a cross-sectional view of a speaker assembly according to an embodiment.

As illustrated in FIG. 1, a speaker assembly 10 according to an embodiment may include a shellpot 12, a speaker basket 14 for receiving and supporting the shellpot 12, and at least one speaker motor 16 received in the shellpot 12. The speaker basket 14 may be formed of a plastic material, for example, a polycarbonate material or any other thermoplastic resin-based material. The shellpot 12 may be constructed from a metallic material or other rigid material.

As is known in the art, the speaker motor 16 may comprise an assembly including a back plate or center pole, a permanent magnet, and a front or top plate (components not shown). The diameter of the speaker motor 16 is less than that of the shellpot 12, thus a space is formed between the motor 16 and the shellpot 12 which is known as the magnetic air gap 18. The motor assembly provides a substantially uniform magnetic field in the air gap 18. A voice coil 20 is positioned within the air gap 18 and extends upwardly to join a diaphragm (not shown). During operation, current from an amplifier (not shown) or some other device supplying electrical signals representing program material to be transduced by the loudspeaker may drive the voice coil 20. Axial reciprocation of the voice coil 20 in the air gap 18 in connection with the diaphragm generates sound representing the program material transduced by the loudspeaker. Other speaker components may alternatively or additionally be included in the speaker assembly 10.

Figure 2:
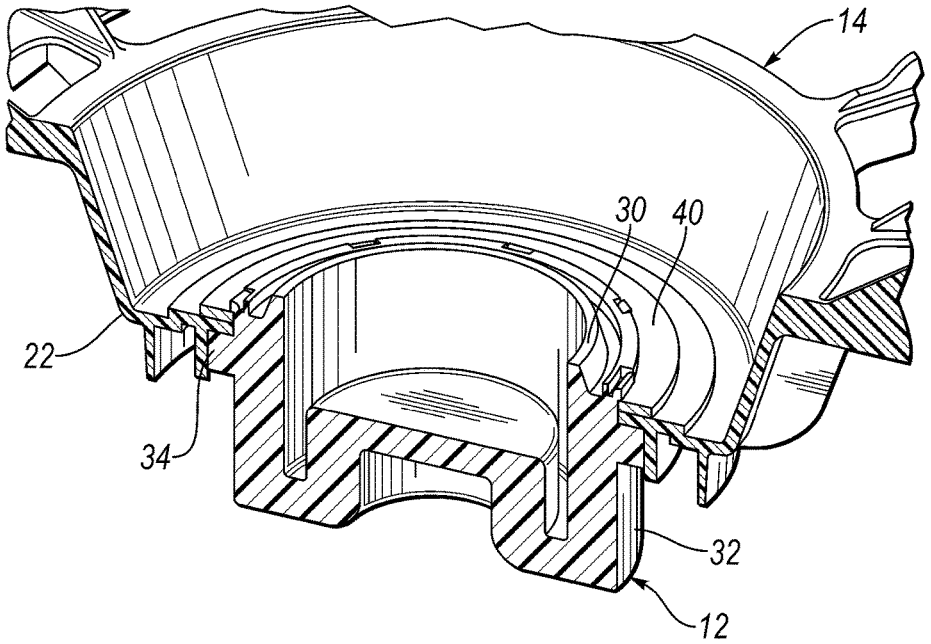
FIG. 2 is a perspective, cut-away view of a shellpot coupled with a speaker basket by an insert member according to the embodiment of FIG. 1.
Figure 3:
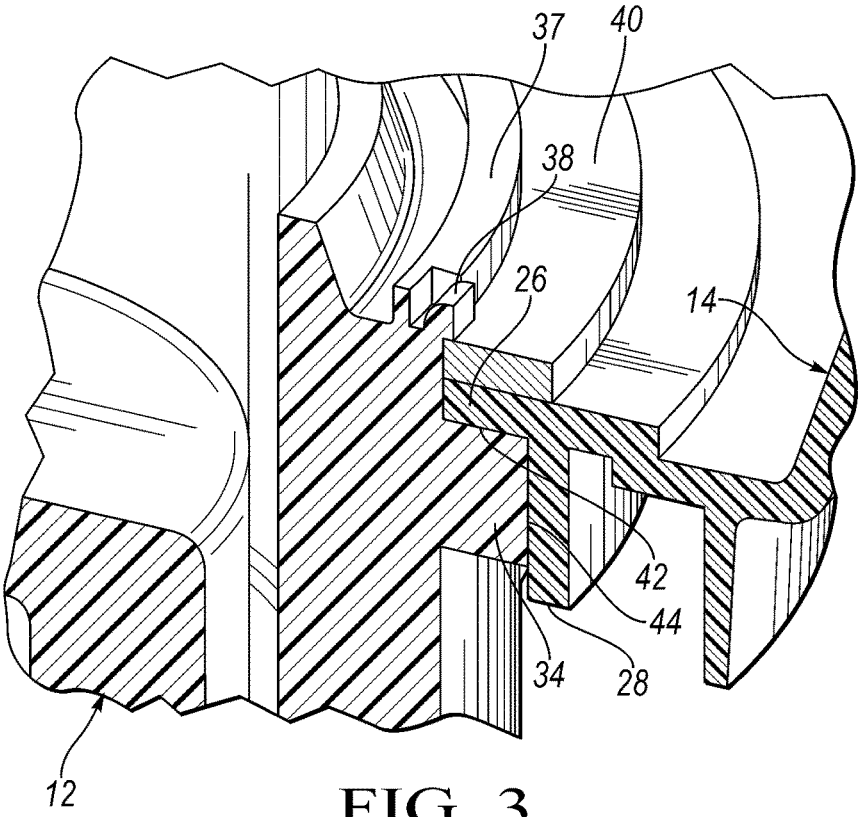
FIG. 3 is an enlarged view of the coupling of the shellpot and speaker basket as shown in FIG. 2.

With reference to FIGS. 1-3, the speaker basket 14 includes a base portion 22 having an opening 24 therein for receiving the shellpot 12. The speaker basket 14 may further include a lip 26 surrounding the opening 24, and may include a flange 28 spaced outwardly from and extending downwardly from the opening 24. It is understood that directional terms such as, but not limited to, "upwardly" and "downwardly" as used herein are to provide reference with respect to the drawings and are not otherwise intended to be limiting.

As best shown in FIGS. 1 and 2, the shellpot 12 may include an upper portion 30 and a lower portion 32. In the embodiment shown, the upper portion 30 and the lower portion 32 have generally equal diameters, although the shellpot 12 is not limited to this configuration. The shellpot 12 includes a protrusion 34 formed along an outer surface 36 thereof and extending circumferentially around the shellpot 12, demarcating the upper portion 30 from the lower portion 32. In the embodiment depicted, the protrusion 34 has a generally rectangular cross-section, although other configurations are also contemplated.

With reference to FIGS. 1-4, the shellpot 12 includes an upstanding rim 37 on the upper portion 30 of the shellpot 12, spaced from the protrusion 34. While the rim 37 is shown as extending upwardly in a generally perpendicular orientation to a plane of the protrusion 34, it is understood that the rim 37 is not limited to this configuration.

An insert member 40 may be disposed adjacent the speaker basket 14 and the rim 37, such as between the lip 26 of the speaker basket 14 and the rim 37, in order to couple the shellpot 12 to the speaker basket 14. In one embodiment, the insert member 40 comprises a generally planar ring having a diameter sized to surround the rim 37 or upper portion 30 of the shellpot 12, as shown in FIGS. 1-4. The insert member 40 may have any thickness suitable for the purpose of coupling the shellpot 12 and the speaker basket 14, and may be constructed from a metallic material, although other materials, such as plastic, may alternatively be used.

Figure 4:
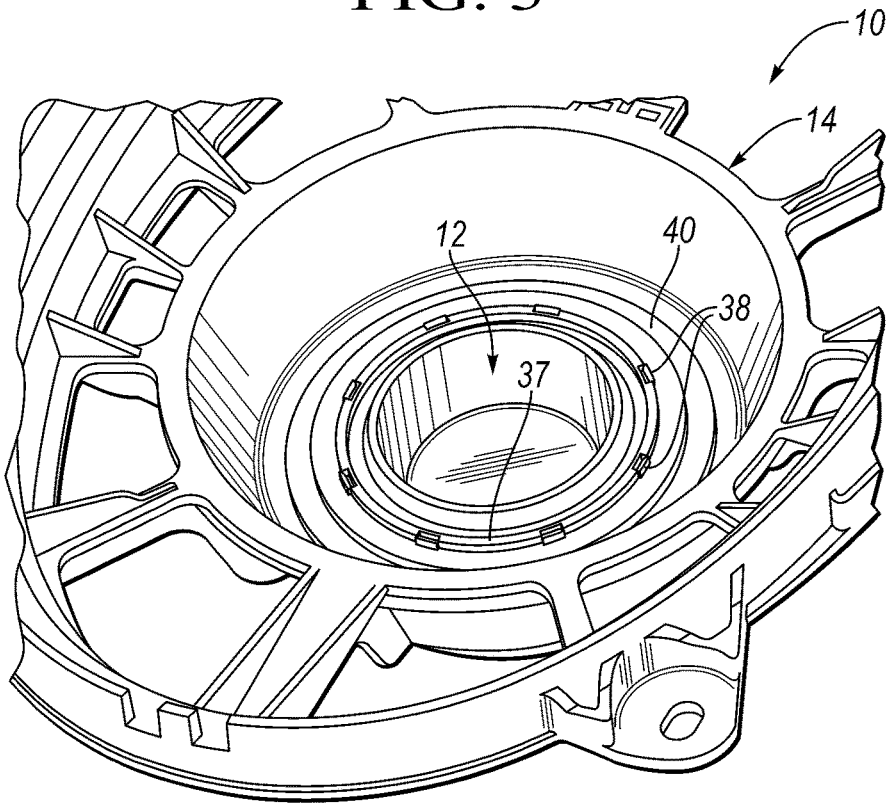
FIG. 4 is a top perspective view of the coupled shellpot and speaker basket according to the embodiment of FIG. 1.
Figure 5:
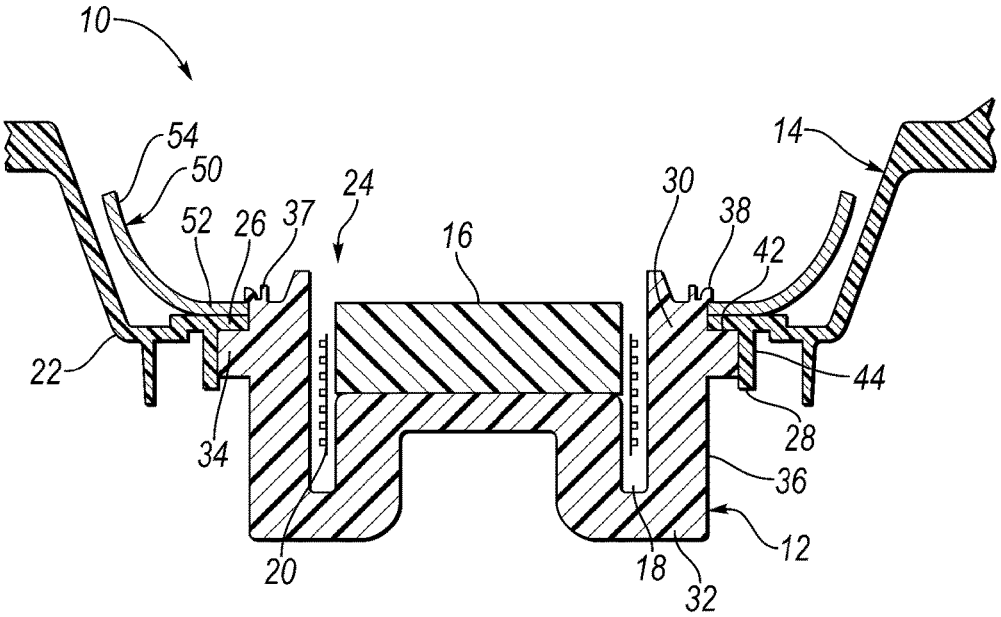
FIG. 5 is a cross-sectional view of a speaker assembly according to another embodiment.
Figure 6:
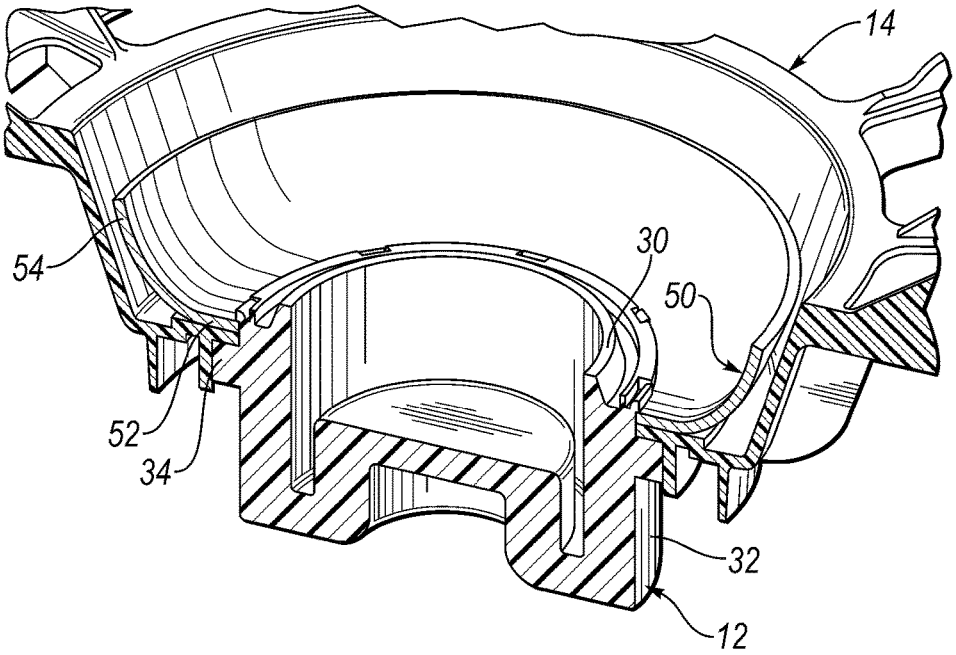
FIG. 6 is a perspective, cut-away view of a shellpot coupled with a speaker basket by an insert member according to the embodiment of FIG. 5.
Figure 7:
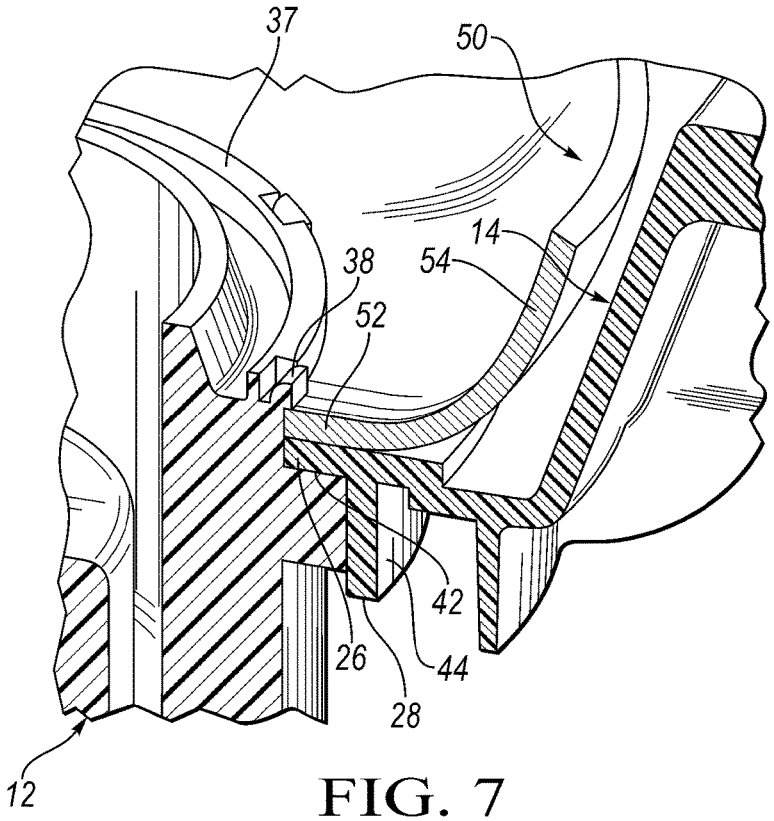
FIG. 7 is an enlarged view of the coupling of the shellpot and speaker basket as shown in FIG. 6.
Figure 8:
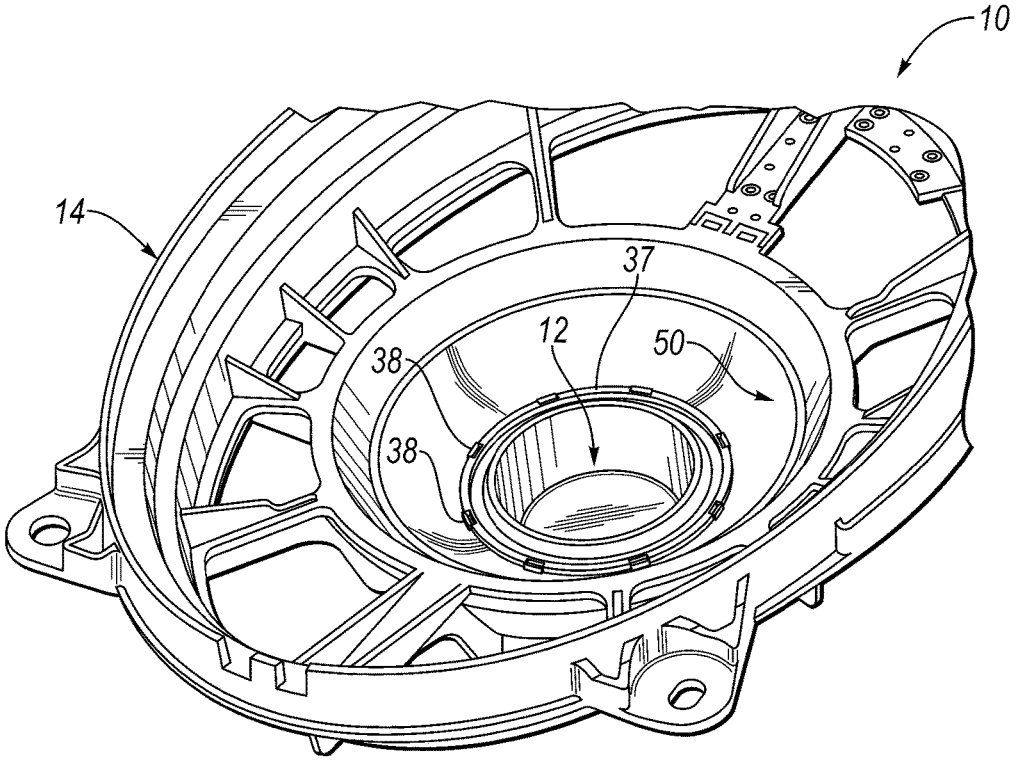
FIG. 8 is a top perspective view of the coupled shellpot and speaker basket according to the embodiment of FIG. 5.

In order to assemble the shellpot 12 to the speaker basket 14, the shellpot 12 is received into the opening 24, such as from an exterior of the speaker basket 14. Once the shellpot 12 is inserted, the insert member 40 is placed over the shellpot 12, such as from an interior of the speaker basket 14. The insert member 40 may be positioned adjacent the rim 37 and the lip 26 of the speaker basket 14. After placement of the insert member 40, a plurality of sections 38 of the rim 37 may be displaced or swedged, such as manually or by a machine, to abut the insert member 40 and couple the shellpot 12 and the speaker basket 14. In one embodiment, the sections 38 are in a spaced configuration circumferentially around the rim 37, although the position of the sections 38 is not limited to this configuration. While eight sections 38 are illustrated in FIG. 4, other numbers of sections 38 are also contemplated. The sections 38 may also be of any width sufficient to capture the insert member 40 between the shellpot 12 and the speaker basket 14.

As shown in FIGS. 1-3, when the shellpot 12 is coupled to the speaker basket 14, the basket lip 26 may be disposed on an upper surface 42 of the shellpot protrusion 34. In addition, the basket flange 28 may engage an end surface 44 of the protrusion 34 when the shellpot 12 is coupled with the speaker basket 14. The engagement of each of the lip 26 and the flange 28 with the protrusion 34 may serve to further stabilize and strengthen the coupling of the shellpot 12 and speaker basket 14.

In another embodiment illustrated in FIGS. 5-8, an insert member 50 may be provided comprising an annular member or ring having an inner portion 52 and an outer portion 54. The inner portion 52, which may be generally planar, is abutted by the sections 38 to couple the shellpot 12 to the speaker basket 14 in the manner described above with reference to FIGS. 1-4. The outer portion 54 extends upwardly into the speaker basket 14. In one embodiment, the outer portion 54 may be generally concave, such that the insert member 50 has a dish-shaped configuration. It is understood that the outer portion 54 may alternatively have another geometry besides the concave configuration depicted herein.

In addition to the purpose of coupling the shellpot 12 and speaker basket 14 together, use of a metallic insert member 50 with its outer portion 54 extending into the speaker basket 14 may also help reduce stray magnetic fields by collecting the magnetic flux, thus maintaining magnetic flux density across the length of the air gap 18 to allow for sufficient movement of the voice coil 20 to result in optimum speaker performance.

Utilizing an insert member 40, 50 allows the shellpot 12 to be assembled to the speaker basket 14 without the use of insert molding. The speaker basket 14 may be placed over the shellpot 12 and then the insert member 40, 50 placed over the shellpot 12, adjacent the upstanding rim 37, wherein a plurality of sections 38 of the rim 37 are then displaced or swedged so that the sections 38 abut the insert member 40, 50 to couple the shellpot 12 and the speaker basket 14. In any of the embodiments disclosed herein, no additional adhesive or other fasteners are required to secure the shellpot 12 and the speaker basket 14 together. In this way, the shellpot 12 and speaker basket 14 can be fastened together easily and securely, and the assembly operation can proceed without needing to allot any time required for adhesive material to harden or additional fasteners to be installed. This attachment interface also allows for the use of multiple shellpot 12 configurations and, thus speaker motor 16 designs, with a single speaker basket 14, thereby reducing manufacturing complexity and cost of the speaker assembly 10.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A speaker assembly, comprising:

a shellpot for receiving a speaker motor, the shellpot including an upstanding rim on an upper portion of the shellpot, wherein the shellpot includes a protrusion extending circumferentially around the shellpot, the protrusion having an upper surface and an end surface;

a speaker basket including a base portion having an opening therein for receiving the shellpot, wherein the speaker basket includes a lip surrounding the opening and a flange spaced outwardly from and extending downwardly from the opening, wherein the flange engages the end surface of the shellpot protrusion when the shellpot is coupled with the speaker basket; and an insert member separate from the speaker basket, the insert member positionable between the lip of the speaker basket and the rim and surrounding an exterior of the rim, wherein a plurality of sections of the rim are displaced to abut the insert member and couple the shellpot to the speaker basket.

2. The speaker assembly of claim 1, wherein the insert member comprises a generally planar ring.

3. The speaker assembly of claim 1, wherein the insert member comprises a metallic material.

4. The speaker assembly of claim 1, wherein the lip engages the upper surface of the shellpot protrusion when the shellpot is coupled with the speaker basket.

5. The speaker assembly of claim 1, wherein the speaker basket comprises a plastic material and the shellpot comprises a metallic material.

6. A speaker assembly, comprising:

a shellpot for receiving a speaker motor, the shellpot including an upstanding rim on an upper portion of the shellpot, wherein the shellpot includes a protrusion on the upper portion thereof extending circumferentially around the shellpot, the protrusion having an upper surface and an end surface;

a speaker basket including a base portion having an opening therein for receiving the shellpot, wherein the speaker basket includes a lip surrounding the opening and a flange spaced outwardly from and extending downwardly from the opening, wherein the flange engages the end surface of the shellpot protrusion when the shellpot is coupled with the speaker basket; and a metallic insert ring separate from the speaker basket, the insert ring positionable between the lip of the speaker basket and the rim, the insert ring having an inner portion which abuts an exterior of the rim to couple the shellpot to the speaker basket and a generally concave outer portion extending into the speaker basket.

7. The speaker assembly of claim 6, wherein a plurality of sections of the rim are displaced to abut the insert ring and couple the shellpot to the speaker basket.

8. The speaker assembly of claim 6, wherein the lip engages the upper surface of the shellpot protrusion when the shellpot is coupled with the speaker basket.

9. The speaker assembly of claim 6, wherein the speaker basket comprises a plastic material and the shellpot comprises a metallic material.

10. A method of assembling a speaker assembly, comprising:

providing a shellpot including an upstanding rim on an upper portion of the shellpot;

providing a speaker basket including a base portion having an opening therein, wherein the speaker basket includes a lip surrounding the opening;

placing the speaker basket over the shellpot such that the shellpot is received in the opening;

placing an insert member over the shellpot, the insert member separate from the speaker basket and positionable between the lip of the speaker basket and the rim and surrounding an exterior of the rim; and displacing a plurality of sections of the rim to abut the insert member and couple the shellpot to the speaker basket.

11. The method of claim 10, further comprising disposing a speaker motor in the shellpot.

12. The method of claim 10, wherein the insert member comprises a generally planar ring.

13. The method of claim 10, wherein the insert member comprises an inner portion and a generally concave outer portion extending into the speaker basket.

14. The method of claim 10, wherein the shellpot includes a protrusion extending circumferentially around the shellpot and having an upper surface, and wherein placing the shellpot over the speaker basket includes engaging the upper surface of the shellpot protrusion with the lip.

15. The method of claim 10, wherein the shellpot includes a protrusion extending circumferentially around the shellpot and having an end surface, and wherein the speaker basket includes a flange spaced outwardly from and extending downwardly from the opening, wherein placing the shellpot over the speaker basket includes engaging the end surface of the shellpot protrusion with the flange.

16. The method of claim 10, wherein the speaker basket comprises a plastic material and the shellpot comprises a metallic material.

* * * * *